US008037728B2

(12) United States Patent
Hosoi

(10) Patent No.: US 8,037,728 B2
(45) Date of Patent: Oct. 18, 2011

(54) APPARATUS FOR PRODUCING BOTTLE CAN

(75) Inventor: Masahiro Hosoi, Gotenba (JP)

(73) Assignee: Universal Can Corporation, Tokyo (JP)

( * ) Notice: Subject to any disclaimer, the term of this patent is extended or adjusted under 35 U.S.C. 154(b) by 970 days.

(21) Appl. No.: 10/569,992

(22) PCT Filed: Aug. 28, 2003

(86) PCT No.: PCT/JP03/10949

§ 371 (c)(1),
(2), (4) Date: Jun. 20, 2006

(87) PCT Pub. No.: WO2005/023450

PCT Pub. Date: Mar. 17, 2005

(65) Prior Publication Data

US 2007/0017089 A1 Jan. 25, 2007

(51) Int. Cl.
*B21D 51/26* (2006.01)
*B21J 11/00* (2006.01)

(52) U.S. Cl. ..... 72/94; 72/405.03

(58) Field of Classification Search ..... 72/94, 379.4, 72/405.03

See application file for complete search history.

(56) References Cited

U.S. PATENT DOCUMENTS 3,913,366 A 10/1975 Nelsen et al.
3,979,448 A 9/1976 Handrick et al.
4,113,133 A 9/1978 Berthet
4,497,758 A 2/1985 Clark
5,293,765 A 3/1994 Nussbaum-Pogacnik
5,551,274 A * 9/1996 Hintz ..... 72/431

FOREIGN PATENT DOCUMENTS

EP 0 275 369 B1 7/1988
EP 0 510 291 A1 7/1991
IT 1246702 11/1994
JP 47-25977 7/1972
JP A-49-049789 5/1974

(Continued)

OTHER PUBLICATIONS

International Search Report for PCT/JP2003/010949 mailed Dec. 16, 2003.

(Continued)

*Primary Examiner* — Debra M Sullivan
(74) *Attorney, Agent, or Firm* — Leason Ellis LLP.

(57) ABSTRACT

This apparatus for producing a bottle can includes a die-ring 22 for holding bottom of a closed-end cylindrical body W, and a tool holding part disposed opposite an opening part of the closed-end cylindrical body W, having plural processing tools 32 for shaping the closed-end cylindrical body W into various forms, the die-ring 22 and the tool holding part being held so that each of them can rotate relatively and move in the direction of a center line of the closed-end cylindrical body W relatively to each other, each of the processing tools shaping the closed-end cylindrical body into various forms to produce a bottle can, further including:

a regulating means 110 for regulating forward movement of each of the processing tools 32 or the die-ring 22 to prevent the space between each of the processing tools 32 and the die-ring 22 at the forward end of the tool holding part or the die-ring, from lessening to be not more than a predetermined value.

19 Claims, 7 Drawing Sheets

FOREIGN PATENT DOCUMENTS

| | | | |
|---|---|---|---|
| JP | 61-206533 | | 9/1986 |
| JP | 62-64500 | A | 3/1987 |
| JP | 63-123606 | | 5/1988 |
| JP | 63230230 | | 9/1988 |
| JP | 5-229545 | | 9/1993 |
| JP | 5229545 | | 9/1993 |
| JP | 6-31497 | A | 2/1994 |
| JP | 09019731 | | 1/1997 |
| JP | 9-122798 | | 5/1997 |
| JP | 10-128474 | A | 5/1998 |
| JP | 10-263732 | A | 10/1998 |
| JP | 2000191006 | | 7/2000 |
| JP | 2001-240188 | A | 9/2001 |
| JP | 2002066674 | | 3/2002 |
| JP | 2002-302194 | A | 10/2002 |
| JP | 2003-191014 | A | 7/2003 |
| JP | 2003-251424 | A | 9/2003 |
| JP | 2003-290855 | A | 10/2003 |
| JP | 2003-320432 | A | 11/2003 |
| SE | 394998 | | 7/1977 |

OTHER PUBLICATIONS

International Preliminary Report on Patentability for PCT/JP2003/010949 completed Mar. 30, 2005.
Notification of Reasons for Rejection for JP2002-054133 from JPO dated Dec. 5, 2005.
Patent Abstracts of Japan for JP10-128474 published May 19, 1998.
Patent Abstracts of Japan for JP6-31497 published Feb. 8, 1994.
Patent Abstracts of Japan for JP62-064500 published Mar. 23, 1987.
Notification of Reasons for Rejection for JP2002-054133 from JPO dated Mar. 2, 2006.
Patent Abstracts of Japan for JP10-263732 published Oct. 6, 1998.
Patent Abstracts of Japan for JP2003-191014 published Jul. 8, 2003.
Patent Abstracts of Japan for JP2002-302194 published Oct. 15, 2002.
Patent Abstracts of Japan for JP2001-240188 published Sep. 4, 2001.
Ohashi et al., "Develpment of the 'Dakara' aluminum screw-top can", Pakaging Technology, Japan Pakaging Technology Association, Sep. 2000, vol. 38, No. 9, pp. 8-15.

* cited by examiner

APPARATUS FOR PRODUCING BOTTLE CAN

CROSS-REFERENCE TO PRIOR APPLICATION

This is a U.S. National Phase Application under 35 U.S.C. §371 of International Patent Application No. PCT/JP2003/010949 filed Aug. 28, 2003 which is incorporated by reference herein. The International Application was published in Japanese on Mar. 17, 2005 as WO 2005/023450 A1 under PCT Article 21(2).

TECHNICAL FIELD

The present invention relates to an apparatus which gives various shapes to a closed-end cylindrical body for producing a bottle can.

BACKGROUND ART

In general, a metallic bottle can (referred to as "a bottle can" hereinafter) is formed by performing processing such as drawing or ironing a metallic sheet made of aluminum or an aluminum alloy in multiple steps, and is widely used as a container for drinks.

An apparatus for producing such a bottle can is equipped with a work holding part which has a die-ring for holding a closed-end cylindrical body shaped from a metallic sheet, and a tool holding part for holding a processing tool for performing a shaping processing on the closed-end cylindrical body, in which the die-ring is circularly arranged and held onto the surface of a disc at one side, whereas the processing tool is circularly arranged and held onto surface of a disc at another side so as to be opposed to each die-ring.

The closed-end cylindrical body is held by the die-ring so as to direct an opening part thereof toward the tool holding part, while aligning the center line thereof with that of the work holding part and tool holding part.

The tool holding part is equipped with various tools (machine tools), as processing tools, for processing corresponding to each processing step, such as plural drawing dies for shaping the opening part of the closed-end cylindrical body into a tapered part or a metal cap by nosing it (neck-in processing), a tool for forming a screw in a metal cap, and a tool for forming a curling part at the open end, etc., and these tools are arranged in order of processing.

It should be noted that as steps of processing which are performed on a closed-end cylindrical body, a neck-in processing to shorten the diameter of the opening part by plural steps, a trimming processing to trim the open-end of the metal cap shaped by the neck-in processing thereby adjusting the height of the closed-end cylindrical body, a screw-shaping processing to shape the metal cap into a screw, a curling part forming processing to curl the open-end part of the metal cap outward in the radial direction, a slot processing to press the outer surface of the curling part inwardly in the radial direction and collapse the outer surface, etc. are exemplary. By using processing tools corresponding to each of these processings, the closed-end cylindrical body is shaped, thereby producing a bottle can.

Moreover, the work holding part and the tool holding part are held so that they can rotate relatively to each other and move in the direction of the center line relatively to each other, and these holding parts rotate relatively to each other, so that each tool can perform processing corresponding to each step on a closed-end cylindrical body when the work holding part and the tool holding part come close to each other, and that the processing tool for the subsequent step can face each closed-end cylindrical body when these holding parts move away from each other. In this way, the action of performing processing when both holding parts come close and rotating when both holding parts move away is repeated, thereby shaping a shoulder part, a metal cap part, a screw shape, etc. successively onto a closed-end cylindrical body to impart the shape of a bottle can.

The bottle can thus shaped is filled with a filling, and then sealed with a cap which is disposed on the metal cap part. The cap is applied by deforming a cap member which is made of aluminum or aluminum alloy shaped into a cup, so as to fit to the screw shape which is formed on the metal cap part. In general, this cap member is applied by rotating disc rollers, while pressing these rollers to the perimeter of the cap member (capping step).

First, the rollers abut an upper part (top face side) of the cap member and start to rotate, and then come into contact with the upper end of the screw thread of the metal cap part while rotating on the perimeter of the cap member, at this time the rollers are introduced by the screw thread shape to come into contact with the thread groove from the upper end of the screw, and rotate up to the lower end of the thread groove. Thus, a screw shape is shaped onto the cap member, thereby applying the cap to the metal cap part of the bottle can.

DISCLOSURE OF INVENTION

However, in accordance with the above conventional apparatus for producing a bottle can, the work holding part and the tool holding part are generally constituted so that these holding parts mutually come close to each other and move away from each other through the intermediary of a crank mechanism, and hence if this action is repeated, then any of the work holding part and the tool holding part may thermally expand due to the frictional heating generated at that time. In this case, because the stroke when the work holding part and the tool holding part come close is identical, there is a problem that the holding position of the closed-end cylindrical body to each processing tool at the beginning of each processing in the above becomes near.

Specifically, there have been various problems, that is, in the case in which the processing tool is a trimming apparatus, the length of the end-closed cylindrical body shortened, in the case in which the processing tool is a tool for forming a screw, the position of formed screw in the direction of the center line of the can is lowered, in the case in which the processing tool is a tool for forming a curling part, the length of the outer surface of the curling part in the direction of the center line of the can is shortened, and in the case in which the processing tool is a tool for processing a slot, a part to be collapsed in the outer surface of the curling part is shifted upward in the direction of the center line of the can, or the length of the part to be collapsed is shortened, thereby producing a bottle can having insufficient sealing property.

Here, in the step of shaping a screw, a neck-in processing is performed in advance of this step, and a closed-end cylindrical body is drawn to the work holding part side when the drawing die to be used in the neck-in processing move away from the closed-end cylindrical body, and hence there has been a particular problem in that the holding position of the closed-end cylindrical body to the work holding part at the beginning of the screw shaping step may rarely widely. In this instance, a desirable screw shape cannot be shaped on the cap member, i.e. miss-capping, for example, the screw shape cannot be shaped in the above capping step, or the above rollers press the screw thread first thus breaking the screw thread, or the like.

The present invention was made in consideration of such circumstances, and it is an object of the present invention to provide an apparatus for producing a bottle can which is capable of stabilizing the holding position of the closed-end cylindrical body to the tool holding part, thereby forming a bottle can with high accuracy.

An apparatus for producing a bottle can of the present invention includes a die-ring for holding the bottom of a closed-end cylindrical body, and a tool holding part disposed opposite an open part of the closed-end cylindrical body, having plural processing tools for shaping the closed-end cylindrical body into various shapes, the die-ring and the tool holding part being held so that each of them can rotate relatively and move in the direction of a center line of the closed-end cylindrical body relatively to each other, each processing tool shaping the closed-end cylindrical body into various forms to produce a bottle can, further including:

a regulating means for regulating forward movement of each of the processing tools or the die-ring to prevent the space between each of the processing tools and the die-ring at the forward end of the tool holding part or the die-ring, from becoming less than a predetermined value.

In accordance with the apparatus for producing a bottle can of the present invention, the die-ring or the tool holding part rotates and moves forward and backward, and this operation is repeated, and even when at least one of the die-ring and the tool holding part is thermally expanded, the space between each processing tool and the die-ring will not become not more than a predetermined value when the die-ring and the tool holding part are come close to each other, because the above regulating means is disposed. Therefore, the holding position of the closed-end cylindrical body with respect to each processing tool at the beginning of processing using each processing tool can be stabilized, thereby forming a bottle can having high accuracy.

The above regulating means may have a stopper vertically disposed on one of the tool holding part side or the die-ring side, and a position regulating member disposed opposite to the stopper, on the other side, so that the stopper and the position regulating member come in contact with each other when the tool holding part or the die-ring moves forward excessively so that the space therebetween lessens to be not more than a predetermined value, thereby regulating the forward movement of the tool holding part or the die-ring.

The above regulating means may have a buffer member which absorbs a regulated forward movement quantity of the processing tool or the die-ring.

In this case, even if at least one of the die-ring and the tool holding part thermally expands, and the die-ring or the tool holding part moves forward in this state, thereby bringing them come close to each other, then the amount of movement in coming close due to the thermal expansion is absorbed by the buffer. Therefore, even if the forward movement of each processing means or the die-ring is regulated by the regulating means so that the space between each processing tool and the die-ring at the forward end position of the tool holding part or the die-ring does not become not more than a predetermined value, then the forward moving force at this time is absorbed by the above buffer member, thereby preventing each processing tool, the tool holding part, and die-ring from being broken.

The processing tool may include a drawing die which shortens the diameter of the open part of the closed-end cylindrical body, and a pressing tool which presses the closed-end cylindrical body to the die-ring after the processing by the drawing die and before it continues to the subsequent step.

The subsequent step may be a step for shaping a metal cap part formed on the closed-end cylindrical body into a screw shape.

In this case, after the neck-in processing by the drawing die and before it continues to the subsequent step, the closed-end cylindrical body is pressed to the die-ring by the pressing tool, and hence the bottom of the closed-end cylindrical body will be reliably disposed onto the die-ring at the beginning of the subsequent step. Moreover, since the above regulating means is provided, the space between the closed-end cylindrical body and the processing tool for the subsequent step is prevented from becoming not more than a predetermined value, when the die-ring and the tool holding part come close to each other.

Thus, it becomes possible to perform the processing in the subsequent step stably at a predetermined position in the direction of the center line of the closed-end cylindrical body, whereby it becomes possible to form a bottle can having high accuracy. In particular, in the case in which the subsequent step is a screw-shaping step, it is possible to produce a bottle can in which miss-capping scarcely occurs during the capping step for disposing a cap on the screw part of the bottle can.

The processing tool may be a trimming tool for trimming the open end of the metal cap formed on the closed-end cylindrical body to adjust the length of the closed-end cylindrical body.

In this case, since the regulating means is provided, the space between the closed-end cylindrical body held by the die-ring and the cutting byte for cutting the open-end of the closed-end cylindrical body is prevented from becoming not more than a predetermined value, when the die-ring and the tool holding part come close to each other. Therefore, it becomes possible to shape stably the closed-end cylindrical body having a desirable length, thereby producing a bottle can having high accuracy.

The processing tool may be a tool for forming a curling part which turns back the opening part of the metal cap shaped on the closed-end cylindrical body outward in the radial direction to form a curling part.

In this case, since the regulating means is provided, the space between the closed-end cylindrical body held by the die-ring and the tool for forming a curling part is prevented from becoming not more than a predetermined value, when the die-ring and the tool holding part come close to each other. Therefore, it becomes possible to form stably the curling part having a highly accurate length of the peripheral surface in the direction of the center line of the closed-end cylindrical body.

The processing tool may be a tool for processing a slot which presses inward in the radial direction the peripheral surface of the curling part which is shaped by turning back the opening part of the metal cap shaped on the closed-end cylindrical body outward in the radial direction, and collapsing the peripheral surface.

In this case, since the regulating means is provided, the space between the closed-end cylindrical body held by the die-ring and the tool for processing a slot is prevented from becoming not more than a predetermined value, when the die-ring and the tool holding part come close to each other. Therefore, it becomes possible to shape the flat part having a suitable length at a suitable location on the outer surface of the curling part shaped at the open end part of the closed-end cylindrical body, the flat part being formed by pressing inwardly and radially, thereby attaining a reliably excellent sealing property of a capped bottle can in which a cap is disposed on the metal cap part of the formed bottle can.

BEST MODE FOR CARRYING OUT THE INVENTION

Hereafter, embodiments of the present invention will be explained, with reference to drawings.

Figure 1:
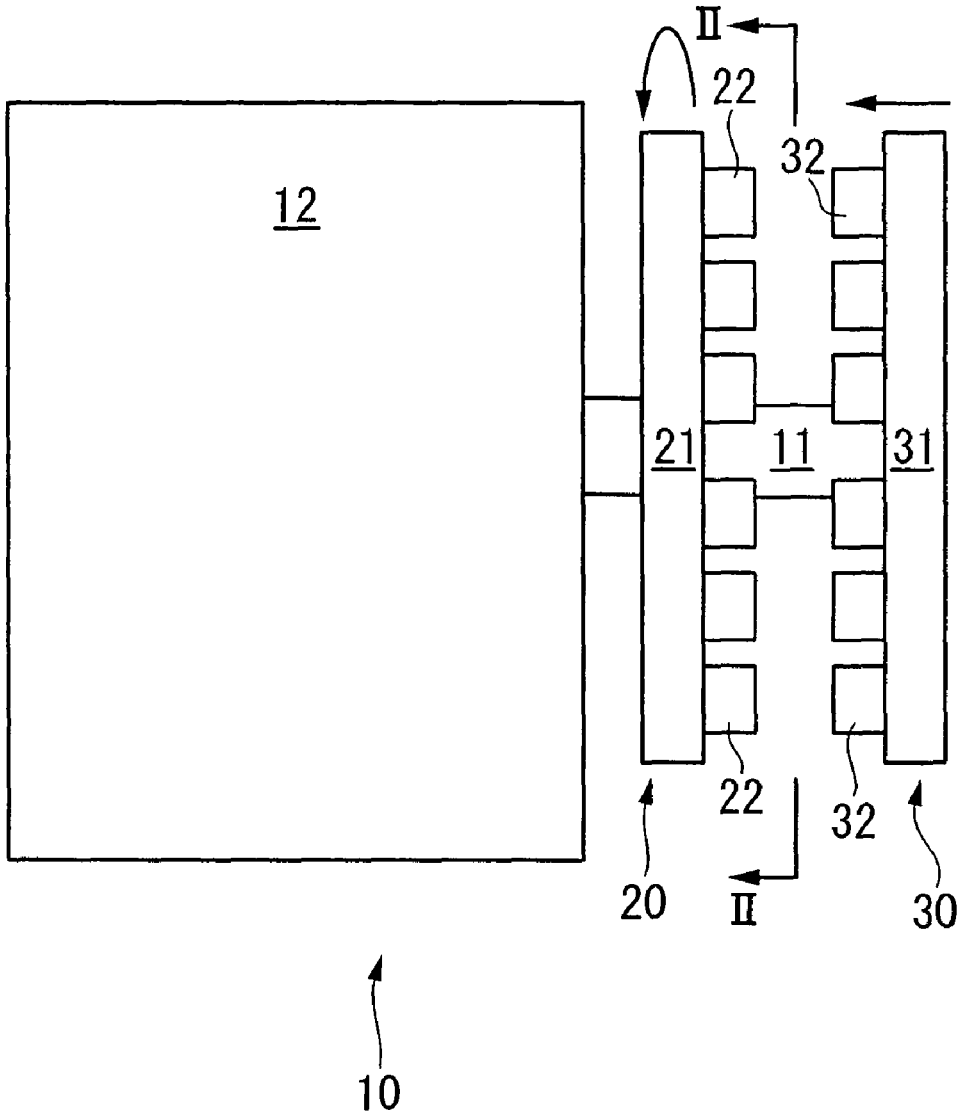
FIG. 1 is a schematic diagram of an apparatus for producing a bottle can shown as one embodiment of the present invention.
Figure 2:
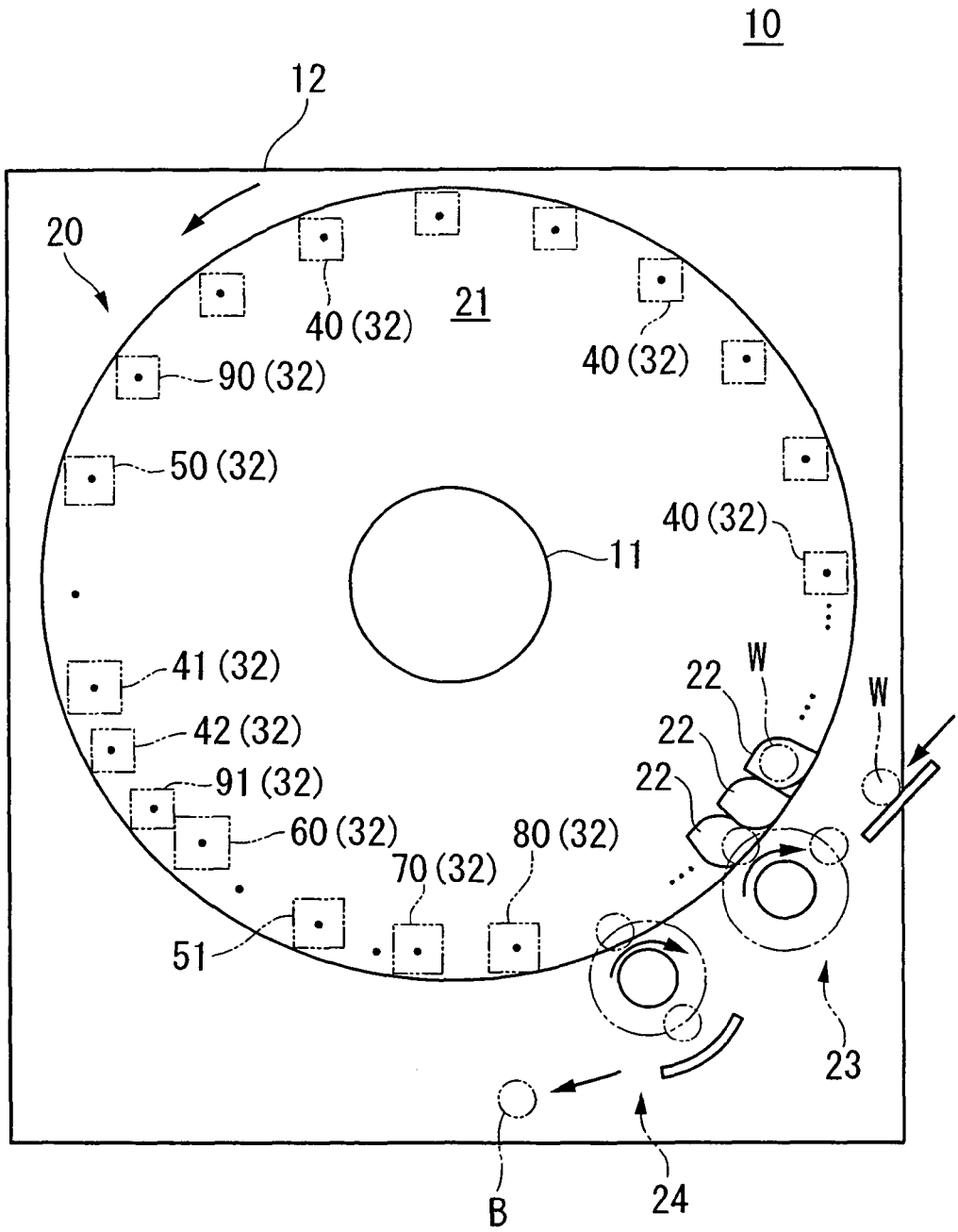
FIG. 2 is a view when looked at from the direction indicated by arrows II-II shown in FIG. 1.

FIGS. 1 and 2 are drawings showing a schematic constitution of a production apparatus 10 for producing a bottle can, by performing various processings described later on a closed-end cylindrical body W which is formed by performing drawing and ironing a metallic sheet made of aluminum or an aluminum alloy.

It should be noted that a bottle can B which is produced by the production apparatus 10 is one which is filled with a carbonated drink, a fruit juice drink, etc., and which is hermetically sealed by applying a cap to a metal cap part having a diameter smaller than that of the trunk of the can and a screw-shape.

The production apparatus 10 consists of a work holding part 20 having a die-ring 22 which holds the closed-end cylindrical body (work) W, a tool holding part 30 which holds a processing tool 32 which shapes and processes the closed-end cylindrical body W, and a driving part 12 which drives both the holding parts 20 and 30, in which these holding parts 20 and 30 are arranged so that the die-ring 22 and the processing tool 32 disposed thereto are opposed to each other, and that each processing tool 32 processes each closed-end cylindrical bodies W.

As shown in FIG. 2, in the work holding part 20, plural die-rings 22 each of which holds a closed-end cylindrical body W are arranged circularly onto the surface of a disc 21 which is held by a supporting shaft 11. This disc 21 is rotated intermittently by the driving part 12 around the supporting shaft 11, thereby supplying the closed-end cylindrical body W from a supplying part 23 to the die-ring 22 as well as discharging in turn the resultant bottle can B thus produced from a discharging part 24. It should be noted that only some of the plural die-rings 22 which are disposed onto the disc 21 are shown in FIG. 2, and the other die-rings 22 are not shown.

Figure 3:
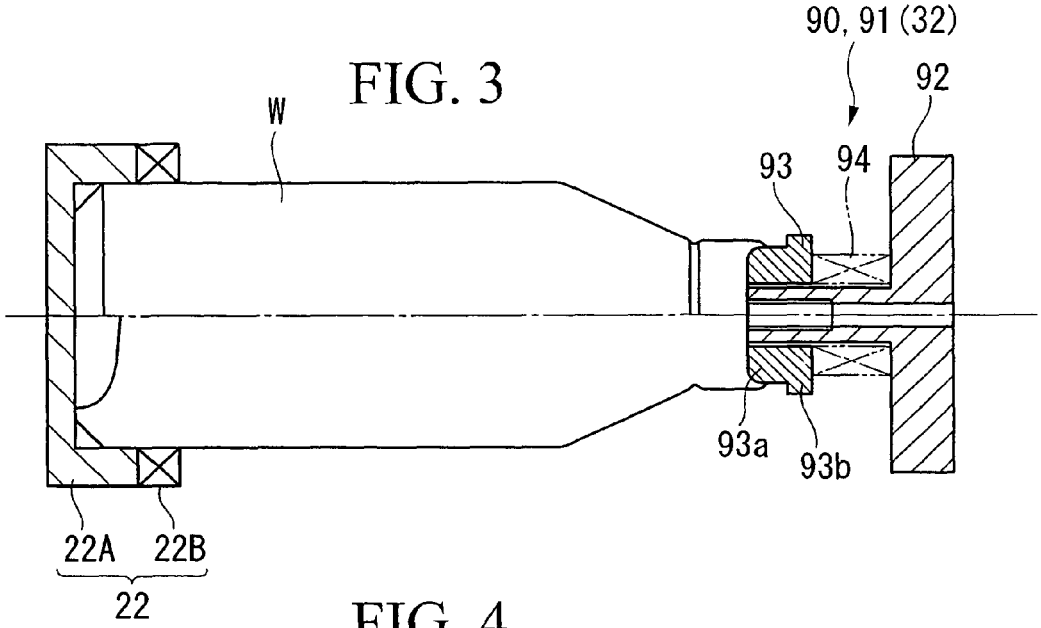
FIG. 3 is a sectional view of the apparatus for producing a bottle can shown in FIG. 1, showing a principal part of the apparatus in a state in which the pressing tool comes close to the closed-end cylindrical body in the pressing step.
Figure 4:
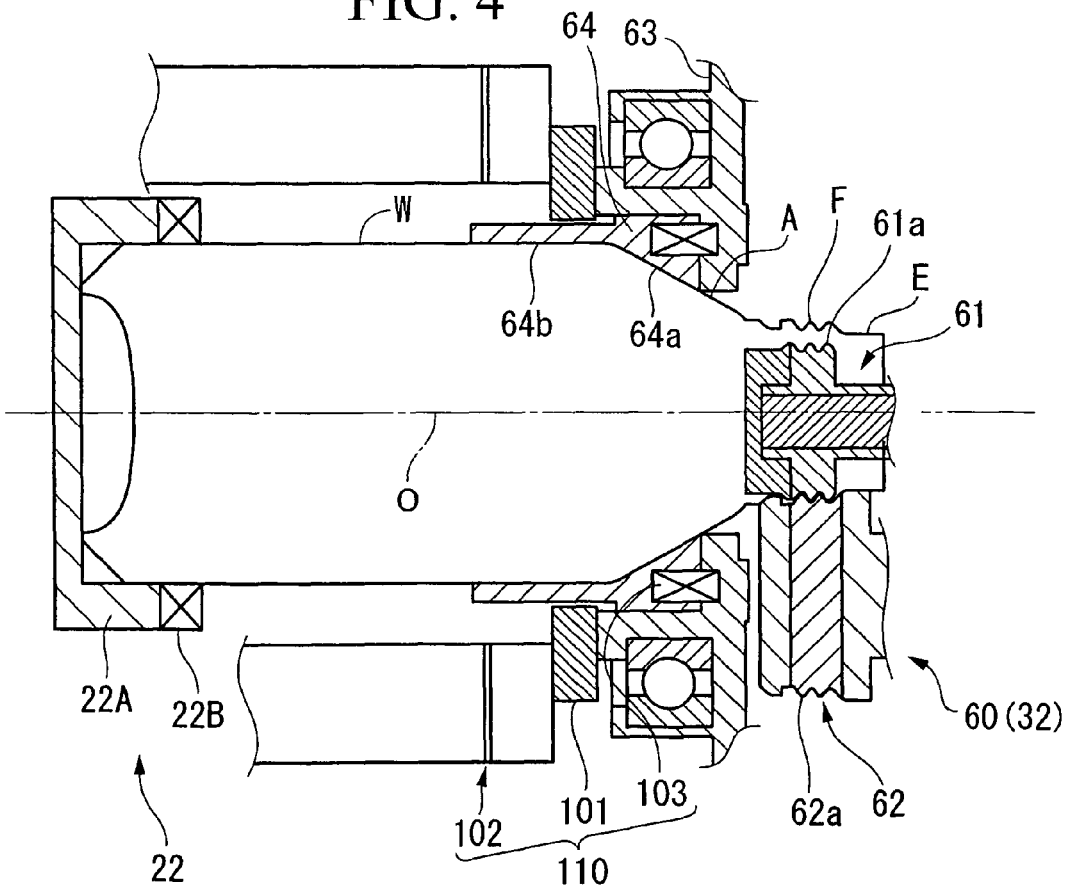
FIG. 4 is a sectional view of the apparatus for producing a bottle can shown in FIG. 1, showing a principal part of the apparatus in a state in which the tool for forming a screw comes close to the closed-end cylindrical body in the screw-forming step.

As shown in FIG. 3, the die-ring 22 consists of a die-ring main body 22A into which the bottom of the closed-end cylindrical body W is fit, and a chuck 22B constituted from an elastic member which is constructed so as to fasten and hold the trunk of the closed-end cylindrical body W by pressurized air. By this die-ring 22, the closed-end cylindrical body W is held so that the opening part thereof is located to the side of the tool holding part 30.

As shown in FIG. 1, the tool holding part 30 consists of a disc 31 which is supported by the supporting shaft 11, and the processing tools 32 which are arranged circularly onto the surface of the disc 31, and the disc 31 is movable in the direction of the center line by the driving part 12 through a crank chain which is not shown in the drawing.

As these processing tools 32, as shown in FIG. 2, two or more of first drawing dies 40, a first pressing tool 90, a first trimming tool 50, a tool for extending diameter 41, a second drawing die 42, a second pressing tool 91, a tool for shaping a screw 60, a second trimming tool 51, a curling part shaping tool 70, and a tool for processing a slot 80, and these processing tools 32 are arranged on the surface of the disc 31 around the work holding part 20 in the order in which they are to be used, i.e. in order from the rear in the direction of rotation of the work holding part 20 to the front. The first drawing die 40 is for shortening the diameter of the opening part of the closed-end cylindrical body, thereby shaping (i.e. a neck-in processing) a shoulder part and a metal-cap-part preform part. The first pressing tool 90 is for pressing the closed-end cylindrical body W after being processed by the drawing die 40 to the die-ring 22. The first trimming tool 50 is for cutting the open end of the closed-end cylindrical body W, thereby adjusting the length of the closed-end cylindrical body W. The tool for extending diameter 41 extends the diameter of the metal-cap-part preform part of the closed-end cylindrical body W. The second drawing die 42 shortens the diameter of the metal-cap-part preform part, the diameter of which is extended in the above except for the lower part in the direction of the center line, thereby shaping a metal cap part having an expanded part on the lower part in the direction of the center line. The second pressing tool 91 presses the closed-end cylindrical body W after being processed by the second drawing die 42 to the die-ring 22. The tool for shaping a screw 60 shapes a screw shape on the metal cap part. The second trimming tool 51 cuts the open end of the closed-end cylindrical body W after the screw is shaped thereto, thereby adjusting the length of the closed-end cylindrical body W. The curling part shaping tool 70 shapes a curling part on the opening end part of the closed-end cylindrical body W. The tool for processing a slot 80 presses the outer surface of the shaped curling part inward in the radial direction, thereby collapsing the surface.

When the tool holding part 30 moves forward and these holding parts 20 and 30 come close to each other, each of the processing tools 32 performs processing corresponding to each step on the closed-end cylindrical body W. On the other hand, when these holding parts 20 and 30 move away from each other, the work holding part 20 rotates until each of the closed-end cylindrical bodies W faces the processing tool for the subsequent step. At this time, the center line of each closed-end cylindrical body W is identical with the center line of each processing tool 32, and in this state, similarly to the above, the tool holding part 30 moves forward and the processing tools 32 for the subsequent step perform processing on the closed-end cylindrical body W.

In this way, by repeating the motion in which these holding parts 20 and 30 come close to each other thereby performing processing and that these holding parts 20 and 30 move away from each other to rotate the disc 31, the shoulder part, the metal cap part, the screw part, etc. are shaped in order, thereby producing a bottle can B.

Each of the above-mentioned processing tools 32 will be explained below.

Figure 8:
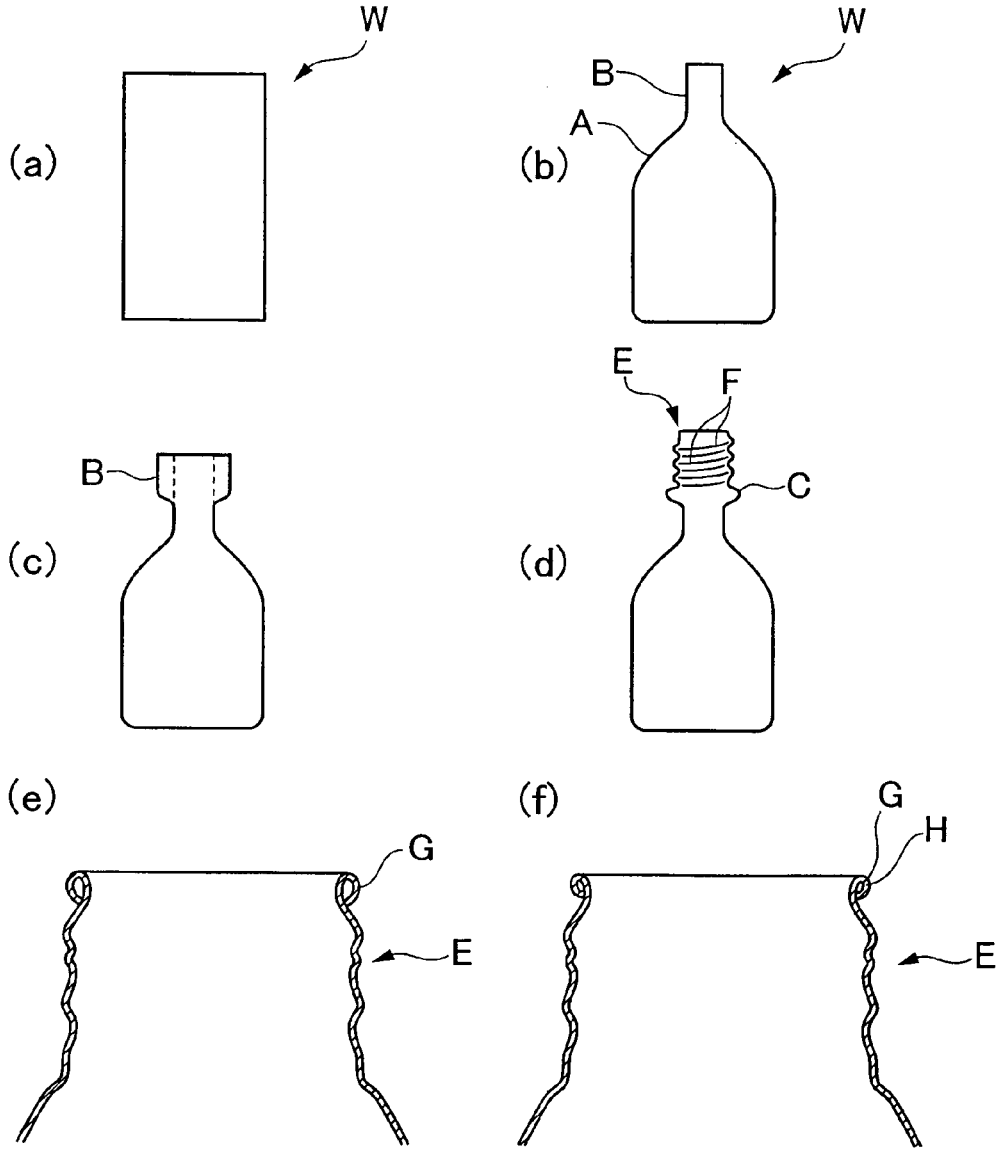
FIGS. 8(*a*)-(*f*) are flowcharts showing the steps for producing a bottle can from a close-end cylindrical body.

As mentioned in the above, the first drawing die 40 shortens the diameter of the opening part of the closed-end cylindrical body stepwisely and sequentially, as shown in FIG. 8, thereby shaping a shoulder part A and a metal-cap-part preform part B on the opening part. The drawing die 40 presses and shapes the outer surface of the opening part of the closed-end cylindrical body W by the inner surface of the drawing die 40 when it is moved forward by the disc 31, and thereafter the drawing die 40 is moved backward by the disc 31 and away from the closed-end cylindrical body W to an upper location in the direction of the center line.

The second drawing die 42 shortens the diameter of a part of the metal-cap-part preform part B (see (c) part of FIG. 8) of the closed-end cylindrical body W, the diameter of which is extended by the tool for extending the diameter 41, except for the lower part in the center line, thereby shaping a metal cap part E having an expanded part C at the lower portion in the direction of the center line (see (d) part of FIG. 8). Similarly to the first drawing die 40, the drawing die 42 presses and shapes the outer surface of the metal-cap-part preform part B of the closed-end cylindrical body W by the inner surface of the drawing die 42 when it is moved forward by the disc 31, and thereafter the drawing die 42 is moved backward by the disc 31 and away from the closed-end cylindrical body W to an upper location in the direction of the center line.

The tool for shaping a screw 60 mainly consists of an inner member 61 which is applied to the inner perimeter of the metal cap E of the closed-end cylindrical body W and an outer member 62 which is applied to outer periphery of the metal cap E of the closed-end cylindrical body W. The tool for shaping a screw 60 as a whole is movable in the direction of an axial line O of the closed-end cylindrical body W by the disc 31 of the tool holding part 30, and supported on the disc 31 rotatably around the axial line O. On the inner member 61 and the outer member 62, uneven screw-shaping parts 61*a* and 62*a* for shaping a screw part F are shaped spirally. These screw-shaping parts 61*a* and 62*a* are shaped so as to be matched with each other (i.e. at the same lead angle), and these are supported so as to be rotatable around each axial line and movable in the radial direction of the closed-end cylindrical body. Moreover, the inner member 61 and the outer member 62 are constituted so that each rotation around each axial line is synchronous by a synchronizing mechanism which is not shown in the drawing, and the inner member 61 and the outer member 62 rotate at a predetermined gear ratio through the synchronizing mechanism.

Here, the inner member 61 and the outer member 62 are disposed inside a housing 63 which is disposed or the surface of the disc 31 of the tool holding part 30, and a ring like position-adjusting member 101 is disposed at an end surface in the forward direction of the housing 63. Inside the position-adjusting member 101, an elastic member 64, which is urged toward the tip end along the forward direction by a spring as a buffer member 103, is disposed in a state such that it can freely pass through. The elastic member 64 has a conical surface 64*a* which matches the shoulder part A of the closed-end cylindrical body W and a cylindrical surface 64*b* which matches the trunk of the closed-end cylindrical body W, so that the elastic member 64 is pressed to the closed-end cylindrical body W when the tool for shaping a screw 60 is moved forward to the closed-end cylindrical body W by the tool holding part 30.

Here, the position-adjusting member 101 is disposed at a position which faces a stopper 102 which is disposed vertically on the surface of the disc 21 of the work holding part 20, so that when the tool holding part 30 moves forward, if the moving amount is larger than the designated value, then the position-adjusting member 101 and the stopper come into contact with each other to regulate the forward motion of the tool holding part 30, thereby making the forward motion end position of the tool for shaping a screw 60 to the closed-end cylindrical body W always constant. These position-adjusting member 101, the stopper 102 and the buffer member 103 constitute regulating means 110.

The first and the second pressing tools 90 and 91 are, as shown in FIGS. 1 and 2, disposed immediately forward in the rotating direction of the position where the drawing dies 40 and 42, respectively, are disposed on the disc 31. A schematic construction of these pressing tools 90 and 91 is shown in FIG. 3.

In FIG. 3, each of the first and the second pressing tools 90 and 91 consists of a pin 92 which is disposed on the disc 31 and a feeder 93 which is disposed movably on the pin 92 in the direction of the center line of the bottle can B, in which the pin 92 and the feeder 93 are linked to each other through an elastic member (for example, a spring) 94. The feeder 93 has a columnar part 93*a* which fits the inner perimeter of the opening part of the closed-end cylindrical body W and a flange 93*b* which comes into contact with the open end surface of the closed-end cylindrical body W. The columnar part 93*a* prevents the open part of the closed-end cylindrical body W which is pressed by the flange 93*b* from being deformed. It should be noted that the repulsive force of the elastic member 94 is set to a degree such that the load applied to the closed-end cylindrical body by the first and the second pressing tools 90 and 91 does not buckle the closed-end cylindrical body W.

In the first and the second pressing tools 90 and 91 thus constituted, when they are moved forward by the disc 31, the flange 93*b* of the feeder 93 comes into contact with the end surface of the open part of the closed-end cylindrical body W, thereby squeezing the closed-end cylindrical body W into the die-ring 22. At this time, since the feeder 93 presses the end surface of the opening part of the closed-end cylindrical body W by way of the elastic member 94, an impact force which acts on the closed-end cylindrical body W when the feeder 93 comes into contact with the closed-end cylindrical body W is moderated by the buffer member 94.

As shown in FIGS. 1 and 2, each of the first and the second trimming tools 50 and 51 consists of a cutting byte 52 for cutting the open end of the closed-end cylindrical body W, a guide part 53 which is disposed inside the open part of the closed-end cylindrical body W to guide the open end and a sucking duct 54 which sucks chips generated at the time of trimming, in which the cutting byte 52 and the guide part 53 are disposed inside the sucking duct 54.

The cutting byte 52 and the guide part 53 are connected to a main shaft 56 which is supported rotatably around the axial line of the bottle can B, by way of a main body part 55. The main shaft 56 is disposed inside a housing 57 so that the tip end of the main shaft 56 projects from the tip end surface of the housing 57 and the main body part 55 is disposed at the tip end of the main shaft 56. To the tip end of the housing 57, an arm 100 is disposed, and onto the surface of the arm 100, the plan sheet like a position-adjusting member 101 is disposed. The position-adjusting member 101 is disposed at a position which faces the stopper 102 which is vertically disposed on the disc 21 of the work holding part 20, so that, if the amount of the moving forward is larger than the designated value when the tool holding part 30 moves forward, then the position-adjusting member 101 and the stopper 102 come into contact with each other, thereby regulating the moving forward of the work holding part 20. The impact force which is generated at this time is moderated by the buffer member 103 which is disposed at the rear side in the moving forward direction to the position where the arm 100 is disposed within the tip end part of the housing 57, thereby preventing each constitutional element of the trimming tools 50 and 51 from being broken.

Figure 5:
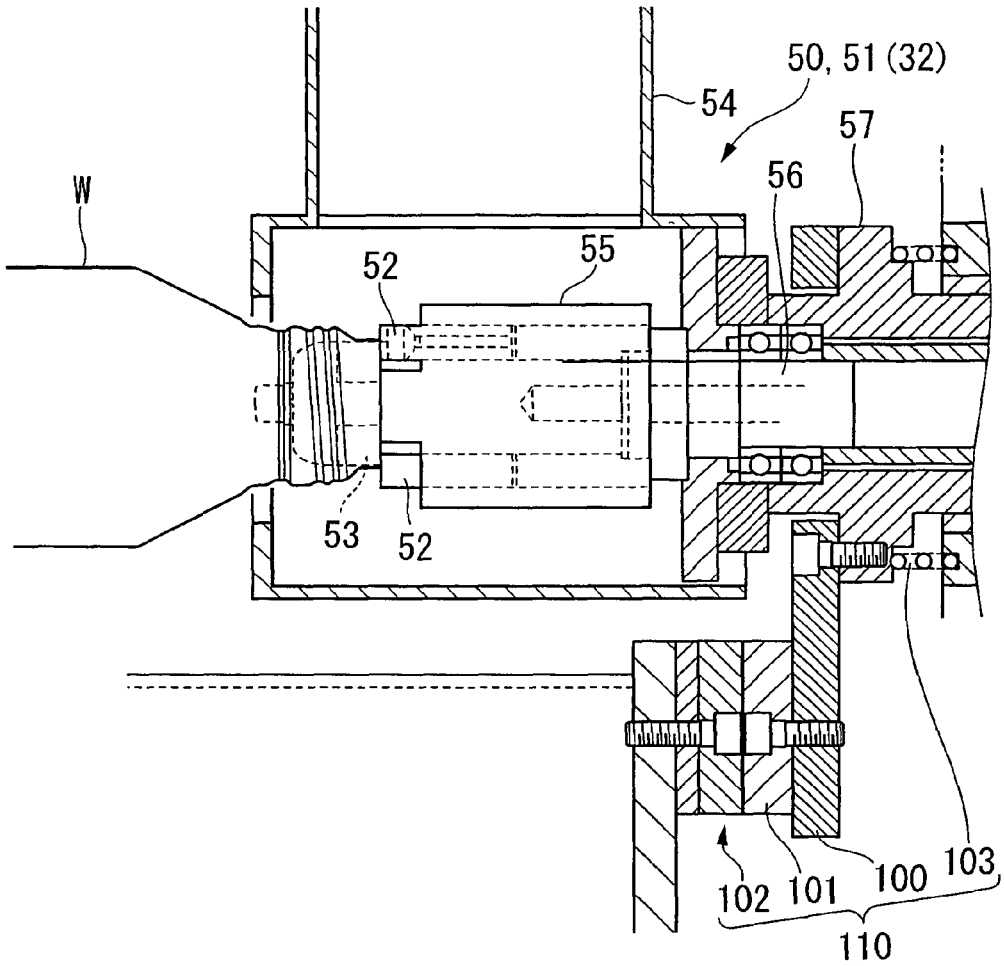
FIG. 5 is a sectional view of the apparatus for producing a bottle can shown in FIG. 1, showing a principal part of the apparatus in a state in which the trimming tool comes close to the closed-end cylindrical body in the trimming step.

Here, the closed-end cylindrical body W which is held in the die-ring 22 is arranged at the forward side in the moving forward direction of the trimming tools 50 and 51, and when the tool holding part 30 moves forward in the axial direction of the bottle can B, as shown in FIG. 5, the guide part 53 is disposed inside the open part of the closed-end cylindrical body W.

The tool for shaping a curling part 70 is, as shown in FIGS. 1 and 2, disposed at a position which is forward in the rotating direction to the position where the second trimming tool 51 is disposed, and backward in the rotating direction to the position where the tool for processing a slot 80 is disposed, which will be mentioned later.

Figure 6:
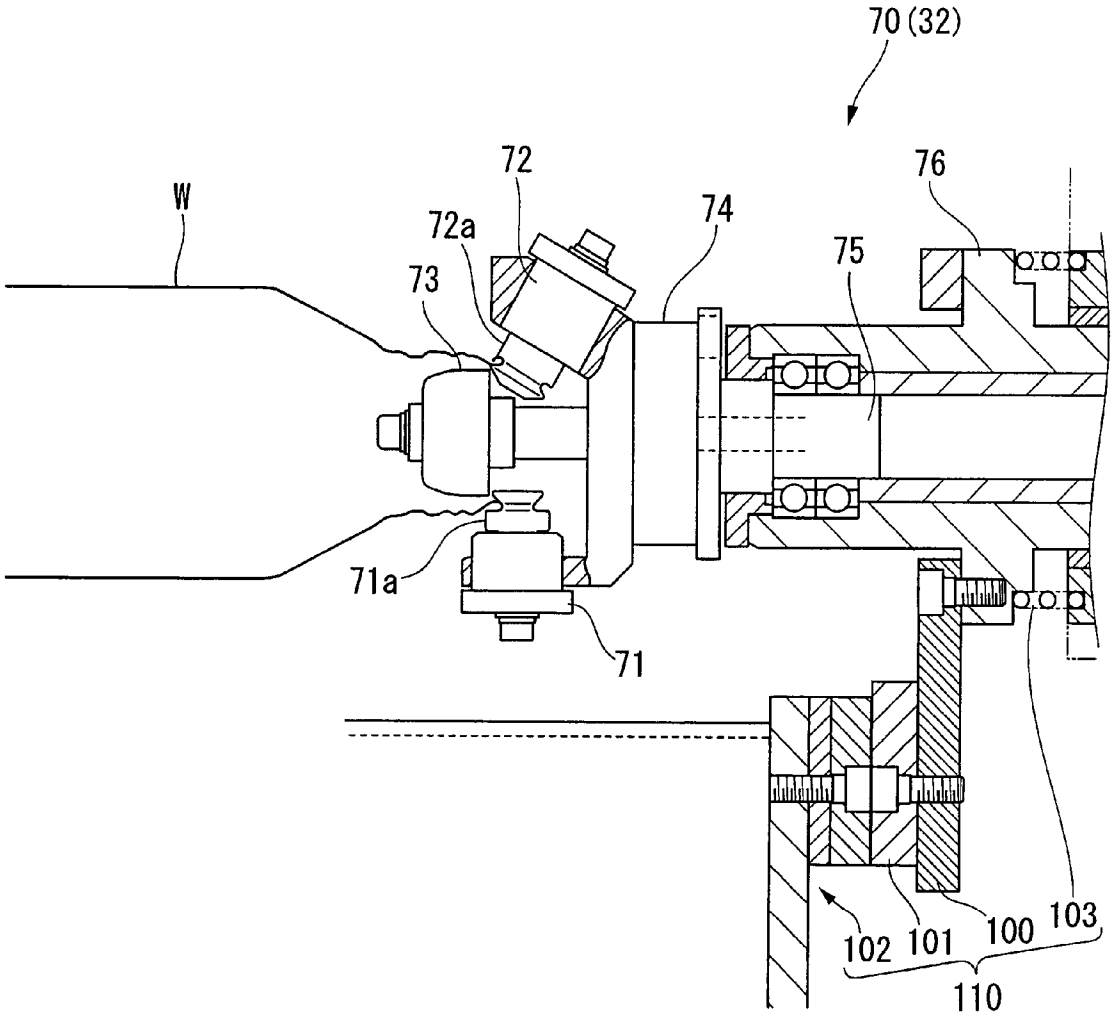
FIG. 6 is a sectional view of the apparatus for producing a bottle can shown in FIG. 1, showing a principal part of the apparatus in a state in which the tool for forming a curling part comes to close to the closed-end cylindrical body.

As shown in FIG. 6, the tool for forming a curling part 70 consists of a turning-back die part 71 for turning back the open end part of the closed-end cylindrical body W in the radially external direction, a bending die part 72 for bending the tip end of the opening end which is turned back by the die 71 so as to be directed in the radially internal direction, and a guide 73 which is disposed inside the open part of the closed-end cylindrical body W to guide the open part. These dies 71 and 72 and the guide 73 are disposed inside a main body part 74, and each of a turning-back die 71*a* and a bending die 72*a* which presses the open part of the closed-end cylindrical body W to shape a curling part is supported rotatably around each of axial line, on each of the tip ends of the dies 71 and 72.

The dies 71 and 72 and the guide 73 are connected to a main shaft 75 which is supported rotatably around an axial line, by way of the main body part 74. The main shaft 75 is disposed inside a housing 76 such that the tip end of the main shaft 75 projects from the end surface of the housing 76, and the main body part 74 is disposed at the tip end of the main shaft 75. To the tip end of the housing 76, similarly to the above trimming tools 50 and 51, an arm 100 which is equipped with the position-adjusting member 101 is disposed, so that, if the amount of moving forward is larger than the designated value when the tool holding part 30 moves forward, then the position-adjusting member 101 and the stopper 102 come into contact with each other, thereby regulating the moving forward of the work holding part 20. The impact force which generates at this time is moderated by the buffer member 103 which is disposed at the tip end of the housing 76, thereby preventing each constitutional element of the tool for shaping a curling part 70 from being broken.

The tool for processing a slot 80 is, as shown in FIGS. 1 and 2, disposed at the most backward position in the rotating direction on the disc 31.

Figure 7:
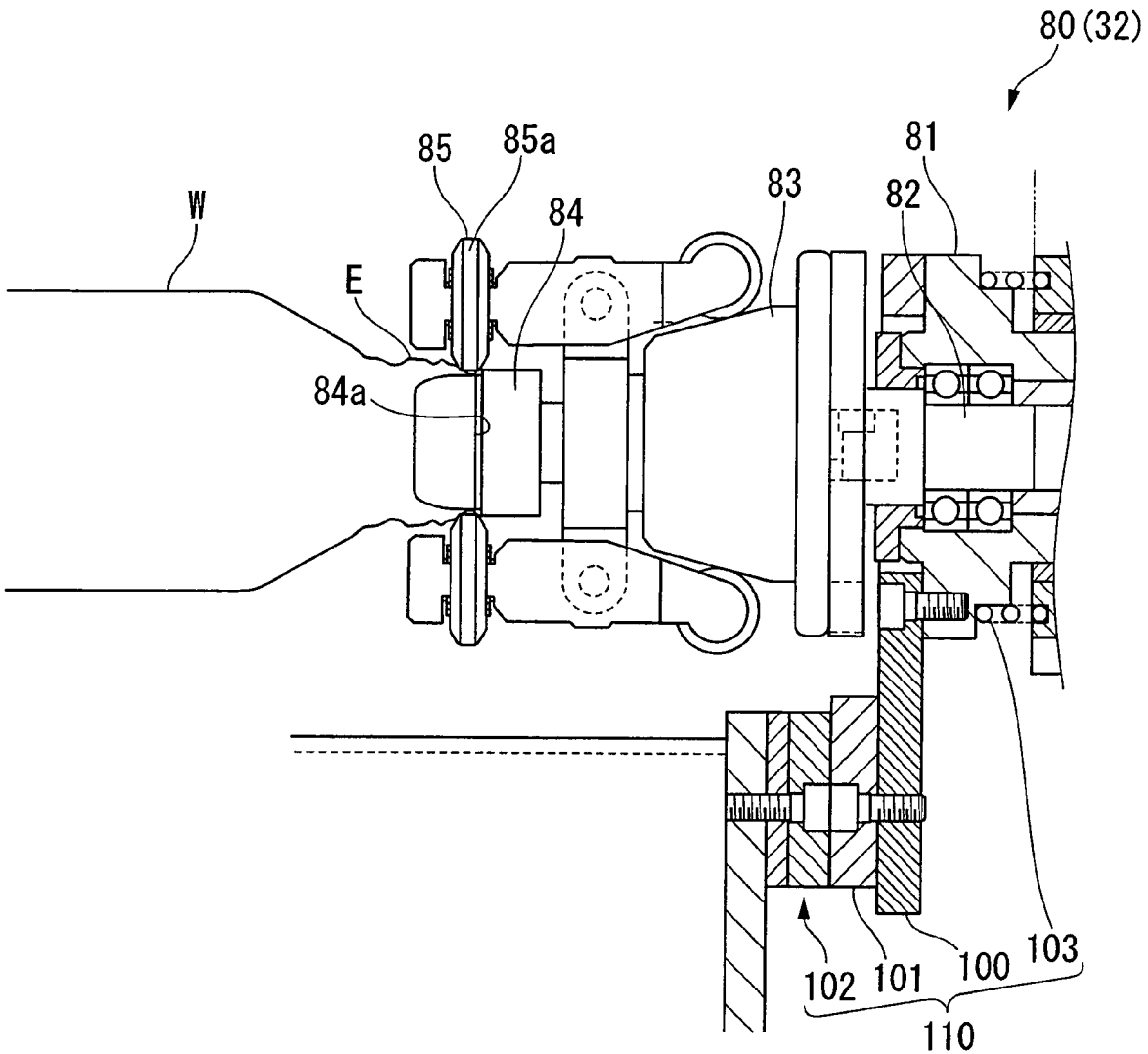
FIG. 7 is a sectional view of the apparatus for producing a bottle can shown in FIG. 1, showing a principal part of the apparatus in a state in which the tool for processing a slot comes to close to the closed-end cylindrical body.

As shown in FIG. 7, the tool for processing a slot 80 consists of a housing 81 which is disposed on the surface of the disc 31 of the tool holding part 30, a main shaft 82 which is disposed inside the housing 81 and supported rotatably, a main body part 83 which is disposed to the tip end of the main shaft 82, an inner member 84 which is connected coaxially with the main body part 83 and disposed inside the metal cap part E of the closed-end cylindrical body W, and two rollers 85, 85 which are supported rotatably around the center line of the main shaft 82 as well as each of the center lines. At approximately the central part in a height direction of the rollers 85 and 85, a pressing surface 85*a* which is flat (i.e. cylindrical surface) over the whole periphery thereof is formed. At approximately the central part in a height direction of the inner member 84, a curved surface 84*a* which has approximately the same curvature radium as in the inner surface of the shaped curling part G when looked at from the side, is formed over the whole periphery of the inner member 84.

To the tip end part of the housing 81, similarly to the above trimming tools 50 and 51, the arm 100 which is equipped with the position-adjusting member 101 is disposed, so that, if the amount of moving forward is larger than the designated value when the tool holding part 30 moves forward, then the position-adjusting member 101 and the stopper 102 come into contact with each other, thereby regulating the moving forward of the work holding part 20. The impact force which is generated at this time is moderated by the buffer member 103 which is disposed at the tip end part of the housing 81, thereby preventing each constitutional element of the tool for processing a slot 80 from being broken.

A process for producing the bottle can B from the closed-end cylindrical body W using the production apparatus 10 for the bottle can thus constituted will be explained.

In FIG. 2, the closed-end cylindrical body W which was conveyed to the apparatus 10 is placed by the supplying part 23 onto the die-ring 22, whereby the bottom part of the closed-end cylindrical body W is held. Then the disc 21 of the work holding part 20 is rotated intermittently around the supporting shaft 11, whereby each of the plural the first drawing dies 40, disposed onto the disc 31 of the tool holding part 30, shortens the diameter of the opening part of the closed-end cylindrical body W sequentially every time the rotation of the disc 21 stops, as shown in FIG. 8, thereby shaping a trunk part, the shoulder part A of which is connected to the upper end of the trunk part in the direction of the center line of the bottle can and the diameter of which is shortened gradually as it goes to the upper part in the direction of the center line of the bottle can, and the metal-cap-part preform part B which is connected to the upper end of the shoulder part A and extended to the upper part in the direction of the center line of the bottle can, having a diameter smaller than that of the trunk part.

Thereafter, if the disc 21 of the work holding part 20 further rotates and stops, then the resultant closed-end cylindrical body W is arranged to face the first pressing tool 90 shown in FIG. 3. Next, if the first pressing tool 90 is moved forward by the disc 31 of the tool holding part 30, then the flange part 93*b* of the feeder 93 comes into contact with the open end surface of the closed-end cylindrical body W, thereby the cylindrical body W is squeezed into the die-ring. At this time, since the feeder 93 presses the opening end surface of the closed-end cylindrical body W by way of the elastic member 94, the impact force which is generated when the feeder 93 comes into contact with the closed-end cylindrical body W is moderated by the elastic member 94. By this, the closed-end cylindrical body W is drawn to the side of the tool holding part 30 when the drawing die 40 move away from the closed-end cylindrical body W to the upper portion in the direction of the center line of the bottle can during the shaping processing step by the first drawing die 40, thereby reliably placing the bottom part of the closed-end cylindrical body W onto the die-ring 22 before the processing in the subsequent step is performed, even in the case in which the bottom of the closed-end cylindrical body W is not placed.

Similarly to the above, if the disc 21 of the work holding part 20 is rotated and stopped, then the closed-end cylindrical body W is arranged to face the first trimming tool 50 shown in FIG. 5, and thereafter the disc 31 of the tool holding part 30 is moved forward, thereby making the cutting byte 52 be in contact with the open end of the closed-end cylindrical body W as well as arranging the guide part 53 inside the closed-end cylindrical body W. And thereafter, the trimming tool 50 is rotated and driven around the center line thereof, thereby cutting the open end of the closed-end cylindrical body W to adjust the height of the closed-end cylindrical body W.

Subsequently, similarly to the above, if the disc 21 of the work holding part 20 is rotated and stopped, then the closed-end cylindrical body W is arranged to face the tool for extending the diameter 41, and after moving the disc 31 of the tool holding part 30 forward in this state, the diameter of the metal-cap-part preform part B of the closed-end cylindrical body W is shortened.

And the resultant closed-end cylindrical body W is arranged to face to the second drawing die 42 by rotating and stopping the disc 21 of the work holding part 20, and the diameter of a part of the metal-cap-part preform part B, the diameter of which is extended by the tool for extending the diameter 42 except for the lower part in the direction of the center line of the bottle can B, is shortened by the inner surface of the drawing die 42, thereby shaping a metal cap part E having the expanded part C at the lower part in the direction of the center line of the bottle can B.

Thereafter, by rotating and stopping the disc 21 of the work holding part 20, the closed-end cylindrical body W is arranged to face the second pressing tool 91 shown in FIG. 3, by moving the disc 31 of the tool holding part 30 forward in this state, similarly to the first pressed tool 90 mentioned in the above, and the closed-end cylindrical body W is pressed downward in the direction of the center line of the bottle can B, thereby placing the bottom of the closed-end cylindrical body W onto the die-ring 22.

Thereafter, the closed-end cylindrical body W is arranged to face the tool for shaping a screw 60 by rotating and stopping the disc 21 of the work holding part 20, and thereafter if the tool for shaping a screw 60 moves forward from an upper portion in the direction of the center line of the bottle can B to a lower portion in the direction of the center line of the bottle can B by the disc 31 of the tool holding part 30, then the inner member 61 is arranged inside the metal cap part E, and the outer member 62 is arranged outside the metal cap part E, and simultaneously the inner surface of the elastic member 64 comes into contact with the shoulder part A and the outer surface of the trunk part of the closed-end cylindrical body W. At this time, since the buffer member 103 is disposed between the housing 63 and the elastic member 64, although the force of driving the tool for shaping a screw 60 forward is transmitted directly to the closed-end cylindrical body W in the course of contacting the inner surface of the buffer member 103 with the outer surface of the closed-end cylindrical body W, the force is suppressed, thereby preventing the closed-end cylindrical body W from being broken by buckling, etc. Moreover, the buffer member 103 moderates the impact force which acts on the tool for shaping a screw 60 when the position-adjusting member 101 and the stopper 102 come into contact with each other, thereby preventing each constitutional element of the tool 60 from being broken.

Thereafter, the inner member 61 is moved outward in the radial direction, the inner surface of the metal cap part E is pressed outward in the radial direction by the screw shaping part 61*a*, simultaneously the outer member 62 is moved inward in the radial direction, the outer surface of the metal cap part E is pressed inward in the radial direction by the screw shaping part 62*a*, in addition, a screw part F is shaped over the whole periphery of the metal cap part E by rotating the inner member 61 and the outer member 62 around the center line of the closed-end cylindrical body W in this state. It should be noted that at this time the end position of moving forward of the tool for shaping a screw 60 is regulated by the stopper 102 and the position-adjusting member 101, and the closed-end cylindrical body W is pressed to the die-ring 22 before this step of shaping a screw, and hence the screw part F is shaped exactly at the desired position of the metal cap part E in the direction of the center line of the bottle can B.

Thereafter, similarly to the above, the resultant closed-end cylindrical body W is arranged to face the second trimming tool 51 shown in FIG. 5 by rotating and stopping the disc 21 of the work holding part 20, and thereafter similarly to the above first trimming tool 50, the open end of the closed-end cylindrical body W is cut to adjust the height of the cylindrical body W.

The resultant closed-end cylindrical body W is, similarly to the above, arranged to face the tool for shaping a curling part 70 shown in FIG. 6, by rotating and stopping the disc 21 of the work holding part 20, and in addition, if the tool for shaping a screw 60 is moved forward from an upper portion in the direction of the center line of the bottle can B to a lower portion in the direction of the center line of the bottle can B by the disc 31 of the tool holding part 30, then the guide part 73 is inserted and arranged inside the open part of the closed-end cylindrical body W. And the main shaft 75 is rotated around the center line thereof by a driving means which is not shown in the drawing, thereby rotating the dies 71*a* and 72*a* around the center line of the main shaft 75, and simultaneously the dies 71*a* and 72*a* are rotated around each center line by being rubbed and making contact with the open end part of the closed-end cylindrical body W, thereby being turned back outward in the radial direction to the open end part of the closed-end cylindrical body, and as a result, a curling part G in which the tip end is bent inward in the radial direction is shaped.

Subsequently, if the disc 21 of the work holding part 20 is rotated and stopped, then the closed-end cylindrical body W is arranged to face the tool for shaping a slot 80, and then when the disc 31 of the tool holding part 30 moves forward, the inner member 84 is arranged inside the metal cap part E and simultaneously the rollers 85, 85 are arranged outside the metal cap part E. Thereafter, each of the rollers 85, 85 moves inward in the radial direction, and the pressing surface 85*a* of the rollers 85, 85 presses the outer surface of the curling part G inward in the radial direction, while supporting the inner surface of the curling part G by the curved surface 84*a* of the inner member 84, thereby collapsing the outer periphery of the curling part G inward in the radial direction to shape the outer periphery into a flat surface (i.e. cylindrical surface) H.

In this way, the bottle can B is produced from the closed-end cylindrical body W. Thereafter, the resultant bottle can B is discharged from the discharging part 24 shown in FIG. 2, and then conveyed to the subsequent step.

As explained in the above, in accordance with the apparatus for producing a bottle can B of this embodiment of the present invention, the work holding part 20 or the tool holding part 30 is rotated and moved forward or backward, and this motion is repeated, so that even when at least one of the work holding part 20 and the tool holding part 30 is expanded by heat, the space between each processing tool 32 and the die-ring 22 is prevented from becoming not more than a predetermined value in the state in which the disc 31 of the tool holding part 30 moves forward, and the work holding part 20 and the tool holding part 20 come close to each other, because the regulating means 110 which has the position-adjusting member 101 and the stopper 102 is provided. Therefore, it is possible to stabilize the holding position of the closed-end cylindrical body W to each processing tool 32 at the beginning of processing using each processing tool 32, thereby shaping a bottle can B having high accuracy.

Moreover, even if at least one of the work holding part 20 and the tool holding part 30 is expanded by heat and the disc 31 of the tool holding part 30 moves forward and these come in contact with each other in this state, the amount of moving due to the expansion by heat is absorbed by the buffer member 103 contained in the regulating means 110. Accordingly, even if the forward motion of each processing tool 32 is regulated by the regulating means 110 so that the space between each processing tools 32 and the die-ring 22 at the end position of forward motion of the tool holding part 30 does not become not more than a predetermined value, the driving force for the forward motion at that time is absorbed by the buffer member 103, thereby preventing each processing tool 32 and the tool holding part 30 from being broken.

Moreover, in this embodiment, it is constituted such that the pressing tools 90 and 91 for pressing the closed-end cylindrical body W downward in the center line of the bottle can B are disposed respectively after the processing by the first and the second drawing dies 40 and 42, and hence the closed-end cylindrical body W is drawn toward the tool holding part 30 when the drawing dies 40 and 42 move away from the closed-end cylindrical body W upward in the direction of the center line of the bottle can B during the shaping processing step by the first and the second drawing dies 40 and 42, and as a result, the bottom of the closed-end cylindrical body W can be reliably disposed onto the die-ring 22 before the processing in the subsequent step is performed, even in the case in which the bottom of the closed-end cylindrical body W is not disposed onto the die-ring 22. By this, it is possible to stabilize the position for starting the processing of the closed-end cylindrical body W in the direction of the center line of the bottle can B in the subsequent step after the processing by the first and the second die-rings 40 and 42, thereby shaping a bottle can B with high accuracy more reliably.

In particular, in this embodiment, as shown in FIG. 2, since the second pressing tool 91 is disposed behind the shaping and processing by the second drawing die 42 and in front of the screw shaping processing by the tool for shaping a screw 60, it becomes possible to make the position for shaping screw of the screw part F in the direction of the center line of the closed-end cylindrical body W highly accurate. Therefore, it becomes possible to reliably produce a bottle can B which rarely causes miss-capping in the capping step for applying a cap to the screw part F of the produced bottle can B. It should be noted that the scope of the present invention is not limited to the above embodiment, and it is possible to add various changes thereto as long as it does not deviate from the spirit of the present invention.

INDUSTRIAL APPLICABILITY

The present invention relates to an apparatus for producing a bottle can, which is suitable for performing various processings on a closed-end cylindrical body to produce a bottle can, and which can stabilize the processing-starting position of the closed-end cylindrical body in the direction of the center line of the cylindrical body, thereby producing a bottle can with high accuracy.

The invention claimed is:

1. An apparatus for producing a bottle can comprising a die-ring disposed to a work holding part for holding the bottom of a closed-end cylindrical body, and a tool holding part disposed opposite an open part of the closed-end cylindrical body, having plural processing tools for shaping the closed-end cylindrical body into various forms, the work holding part and the tool holding part being held so that each can rotate relatively and move in the direction of a center line of the closed-end cylindrical body relatively to each other, each of the processing tools shaping the closed-end cylindrical body into various forms to produce a bottle can, further comprising:

a regulating means for regulating forward movement of each of the processing tools or the work holding part to prevent the space between each of the processing tools and the work holding part at the forward end of the tool holding part or the work holding part, from becoming equal to or less than a predetermined value, wherein the regulating means comprises:

a stopper disposed to one of the tool holding part or the working holding part, and a position regulating member disposed opposite the stopper, on one of the work holding part or the tool holding part, so that the stopper and the position regulating member mechanically come in contact with each other when the work holding part or the tool holding part moves forward excessively so that the space therebetween becomes equal to or less than a predetermined value, thereby regulating the forward movement of the tool holding part or the work holding part.

2. The apparatus for producing a bottle can as set forth in claim 1, wherein the regulating means has a buffer member which absorbs a regulated forward movement quantity of the processing tool or the die-ring.

3. The apparatus for producing a bottle can as set forth in claim 2, wherein the processing tool is a drawing die which shortens the diameter of the opening part of the closed-end cylindrical body, and a pressing tool which presses the closed-end cylindrical body to the die-ring after the processing by the drawing die and before it continues to the subsequent step.

4. The apparatus for producing a bottle can as set forth in claim 3, wherein the processing tool is further configured to shape a metal cap part formed on the closed-end cylindrical body into a screw shape.

5. The apparatus for producing a bottle can as set forth in claim 2, wherein the processing tool is a tool for shaping a metal cap part formed on the closed-end cylindrical body into a screw shape.

6. The apparatus for producing a bottle can as set forth in claim 2, wherein the processing tool is a trimming tool for trimming the open end of the metal cap formed on the closed-end cylindrical body to adjust the length of the closed-end cylindrical body.

7. The apparatus for producing a bottle can as set forth in claim 2, wherein the processing tool is a tool for forming a curling part which turns back the opening part of the metal cap formed on the closed-end cylindrical body in the outward radial direction to form a curling part.

8. The apparatus for producing a bottle can as set forth in claim 2, wherein the processing tool is a tool for processing a slot which presses inward in a radial direction the circumferential surface of the curling part which is formed by turning back the opening part of the metal cap formed on the closed-end cylindrical body in the outward radial direction, and collapsing the circumferential surface.

9. The apparatus for producing a bottle can as set forth in claim 1, wherein the processing tool is a drawing die which shortens the diameter of the opening part of the closed-end cylindrical body, and a pressing tool which presses the closed-end cylindrical body to the die-ring after the processing by the drawing die and before it continues to the subsequent step.

10. The apparatus for producing a bottle can as set forth in claim 9, wherein the processing tool is further configured to shape a metal cap part formed on the closed-end cylindrical body into a screw shape.

11. The apparatus for producing a bottle can as set forth in claim 1, wherein the processing tool is a tool for shaping a metal cap part formed on the closed-end cylindrical body into a screw shape.

12. The apparatus for producing a bottle can as set forth in claim 1, wherein the processing tool is a trimming tool for trimming the open end of the metal cap formed on the closed-end cylindrical body to adjust the length of the closed-end cylindrical body.

13. The apparatus for producing a bottle can as set forth in claim 1, wherein the processing tool is a tool for forming a curling part which turns back the open part of the metal cap formed on the closed-end cylindrical body in the outward radial direction to form a curling part.

14. The apparatus for producing a bottle can as set forth in claim 1, wherein the processing tool is a tool for processing a slot which presses inward in a radial direction the circumferential surface of the curling part which is formed by turning back the opening part of the metal cap formed on the closed-end cylindrical body in the outward radial direction, and collapsing the circumferential surface.

15. The apparatus for producing a bottle can as set forth in claim 1, wherein:

the processing tool is a tool for shaping a metal cap part formed on the closed-end cylindrical body into a screw shape, the position regulating member is disposed on the tool holding part in the vicinity of the tool for shaping the metal cap part into a screw shape, and the stopper is disposed to the position opposite to the position regulating member, on the work holding part.

16. The apparatus for producing a bottle can as set forth in claim 1, wherein:

the processing tool is a trimming tool for trimming an open end of a metal cap formed on the closed-end cylindrical body to adjust a length of the closed-end cylindrical body, the position regulating member is disposed to the tool holding part in the vicinity of the trimming tool, and the stopper is disposed to the position opposite to the position regulating member, on the work holding part.

17. The apparatus for producing a bottle can as set forth in claim 1, wherein:

the processing tool is a tool for forming a curling part which turns back an open part of a metal cap formed on the closed-end cylindrical body in the outward radial direction to form a curling part, the position regulating member is disposed to the tool holding part in the vicinity of the tool for forming a curling part, and the stopper is disposed to the position opposite to the position regulating member, on the work holding part.

18. The apparatus for producing a bottle can as set forth in claim 1, wherein:

the processing tool is a tool for processing a slot which presses inward in a radial direction on a circumferential surface of a curling part which is formed by turning back an open part of a metal cap formed on the closed-end cylindrical body in the outward radial direction, and collapsing the circumferential surface, the position regulating member is disposed to the tool holding part in the vicinity of the tool for processing a slot, and the stopper is disposed to the position opposite to the position regulating member, on the work holding part.

19. An apparatus for producing a bottle can comprising:

a holder which holds a plurality of bottle cans made of metal and rotates intermittently, while arranging the bottle cans circularly thereon, a tool holding part which moves forwardly and backwardly in the direction of the bottle can held in the holder, a plurality of diameter-shortening devices disposed to the tool holding part, a trimmer which adjusts a length of the bottle can, disposed to the tool holding part, a screw-shaping device which shapes a screw on an outer circumference of a metal cap part, disposed to the tool holding part, a curler which forms a curling part by turning back an open end of the metal cap outwardly, disposed to the tool holding part, and a regulator comprising a position-regulating member and a stopper, wherein the position-regulating member is disposed to each of the part of the tool holding part in the vicinity of the screw-shaping device and the curler, and the stopper is disposed to the part of the holder opposite to each of the position-regulating member, such that the position-regulating member mechanically comes into contact with the stopper respectively, when the tool holding part moves forwardly to the holder, thereby regulating the distance between the holder and the tool holding part.

* * * * *